US012213598B2

(12) United States Patent
Frisch

(10) Patent No.: US 12,213,598 B2
(45) **Date of Patent: *Feb. 4, 2025**

(54) STACKABLE, CONNECTABLE FOLDING CHAIR

(71) Applicant: Thomas Mario Frisch, Wilmington, DE (US)

(72) Inventor: Thomas Mario Frisch, Wilmington, DE (US)

( * ) Notice: Subject to any disclaimer, the term of this patent is extended or adjusted under 35 U.S.C. 154(b) by 127 days.

This patent is subject to a terminal disclaimer.

(21) Appl. No.: 18/124,694

(22) Filed: Mar. 22, 2023

(65) Prior Publication Data

US 2023/0301434 A1 Sep. 28, 2023

Related U.S. Application Data

(60) Provisional application No. 63/322,242, filed on Mar. 22, 2022.

(51) Int. Cl.

| | |
|---|---|
| ***A47C 3/04*** | (2006.01) |
| ***A47C 1/14*** | (2006.01) |
| ***A47C 4/02*** | (2006.01) |
| ***A47C 4/28*** | (2006.01) |
| ***A47C 4/44*** | (2006.01) |
| ***A47C 4/52*** | (2006.01) |
| *A45F 3/00* | (2006.01) |
| *A45F 4/02* | (2006.01) |

(52) U.S. Cl.

CPC ..... *A47C 4/283* (2013.01); *A47C 1/14* (2013.01); *A47C 3/04* (2013.01); *A47C 4/28* (2013.01); *A47C 4/44* (2013.01); *A47C 4/52* (2013.01); *A45F 2003/003* (2013.01); *A45F 4/02* (2013.01)

(58) Field of Classification Search

CPC .... A47C 1/14; A47C 3/04; A47C 4/28; A47C 4/44; A47C 4/52; A45F 3/04; A45F 4/02; A45F 2003/003

USPC ..... 297/17, 27, 129, 130, 239, 243; 224/155

See application file for complete search history.

(56) References Cited

U.S. PATENT DOCUMENTS

| | | | |
|---|---|---|---|
| 3,594,038 | A | 7/1971 | Polsky et al. |
| 3,614,157 | A | 10/1971 | Hendrickson et al. |
| 3,669,491 | A | 6/1972 | Weslock |

(Continued)

FOREIGN PATENT DOCUMENTS

| | | |
|---|---|---|
| CN | 100562271 | 11/2009 |
| CN | 213308492 | 1/2021 |

(Continued)

*Primary Examiner* — Robert Canfield

(74) *Attorney, Agent, or Firm* — McCarter & English, LLP

(57) ABSTRACT

A folding chair including holders for stacking and connection of multiple chairs to each other is provided. Each folding chair includes a back support member pivotally connected to a seat member, front and rear leg frames pivotally connected proximal to front ends and rear ends of opposing side bars of the seat member, respectively, and arm rests pivotally connected to opposing side bars of the back support member. The folding chair includes one or more first and second holders operably attached to the back support member and the rear leg frame, respectively. Using the first and second holders, the folding chair is connectable to another folding chair and in turn to another folding chair(s) to form a connected stack of folding chairs that can be carried and transported by a user.

20 Claims, 13 Drawing Sheets

(56) References Cited

U.S. PATENT DOCUMENTS

| | | | | |
|---|---|---|---|---|
| 3,825,300 | A | 7/1974 | Lieberman et al. | |
| 4,224,721 | A | 9/1980 | Ohlson | |
| 4,688,961 | A | 8/1987 | Shioda et al. | |
| 5,297,708 | A | 3/1994 | Carpenter | |
| 5,318,342 | A | 6/1994 | Hall | |
| 5,536,064 | A * | 7/1996 | MacLean | A45F 4/02 224/155 |
| 5,542,159 | A | 8/1996 | Schultz et al. | |
| 5,572,088 | A * | 11/1996 | Aizawa | H01J 61/28 313/631 |
| 5,588,696 | A | 12/1996 | Jay | |
| 5,954,396 | A | 9/1999 | Kemnitzer | |
| 5,957,530 | A | 9/1999 | Gutgsell | |
| 7,118,172 | B1 | 10/2006 | Pattison-Sheets | |
| D547,981 | S | 8/2007 | Cohen | |
| 7,325,875 | B1 | 2/2008 | Guerrini | |
| D571,115 | S | 6/2008 | Cohen | |
| 9,049,916 | B2 | 6/2015 | Berei | |
| 9,185,983 | B1 | 11/2015 | Cohen | |
| 10,881,212 | B2 | 1/2021 | Liu | |
| 11,168,836 | B2 | 11/2021 | Kelly | |
| 11,330,907 | B1 * | 5/2022 | Frisch | A47C 3/04 |
| 11,766,125 | B1 * | 9/2023 | Frisch | A47C 3/04 297/17 |
| 2004/0206790 | A1 | 10/2004 | Welsh | |
| 2009/0256401 | A1 | 10/2009 | Hensley | |
| 2013/0214565 | A1 | 8/2013 | Nickell | |
| 2015/0366357 | A1 | 12/2015 | Nelson | |
| 2019/0045908 | A1 | 2/2019 | Zhu et al. | |
| 2019/0374033 | A1 | 12/2019 | Grace | |
| 2020/0214451 | A1 | 7/2020 | Garrison | |
| 2020/0229606 | A1 | 7/2020 | Liu | |
| 2020/0268131 | A1 | 8/2020 | McDowell | |

FOREIGN PATENT DOCUMENTS

| | | |
|---|---|---|
| WO | 2019/165090 | 8/2019 |
| WO | 2021/026226 | 2/2021 |

* cited by examiner

STACKABLE, CONNECTABLE FOLDING CHAIR

CROSS-REFERENCE TO RELATED APPLICATIONS

This application claims priority to and the benefit of U.S. Provisional Patent Application No. 63/322,242, filed on Mar. 22, 2022, and titled "Stackable, Connectable, Backpack Beach Chair". The entire content of the foregoing provisional application is incorporated herein by reference in its entirety.

BACKGROUND

Folding chairs are typically used in leisure and recreational settings, for example, on a beach, on a deck, near a pool, at a game, or in a backyard. These types of chairs can be unfolded into a deployed configuration for use and folded into a folded configuration for compact storage and transportation. Despite the ability to fold a folding chair to a smaller profile, it is difficult for a user to carry multiple folded chairs together at the same time. Often, the folded chairs are difficult to grip and may unfold while being carried, potentially causing the user to drop the chairs. A user may therefore consider transporting multiple chairs in a wagon or a similar vehicle that can be pulled. However, such vehicles are bulky, difficult to maneuver in sand, and potentially expensive.

Some folding chairs can include straps that allow the folding chairs to be supported against the user's back when carried in a folded configuration. However, such straps only apply to a single folded chair, and do not facilitate connection or securement of additional chairs. It would be difficult or impossible for the user secure the straps of each individual chair to themselves in an effective manner for carrying multiple folded chairs together at the same time. Some folding chairs can include components that facilitate transport or storage of a folding chair and other items. However, these components are typically separate accessory attachment devices, for example, brackets, adapters, or the like, that are not integrated within the folding chair itself. It is difficult and expensive to acquire and assemble such attachment devices, which typically only facilitate attachment of various accessories and do not facilitate attachment of additional folding chairs. These attachment devices are not permanently attached to the folding chair and may be easily lost. These attachment devices further lack a means remaining connected to the folding chair for convenience without obstructing or otherwise interfering with a regular use of the folding chair.

Hence, there is a long-felt need for a stackable, connectable folding chair that provides a means for conveniently maintaining the chair in the folded configuration, and allowing multiple chairs to be secured to each other in the folded configuration for transport.

SUMMARY

This summary is provided to introduce a selection of concepts in a simplified form that are further disclosed in the detailed description of the invention. This summary is not intended to determine the scope of the claimed subject matter.

In accordance with embodiments of the present disclosure, an exemplary folding chair is provided that includes holders that facilitate connection and stacking of multiple folding chairs to one another when the folding chairs are in a folded configuration. The holders allow multiple chairs to be easily carried by a user in the folded configuration, when supported using one or more straps attached to the folding chair. The apparatus/folding chair disclosed herein therefore addresses the above-recited need. The holders are integrated with the stackable, connectable folding chair to prevent loss of the holders and to allow for convenient access/use of the holders during folding and stacking of multiple chairs relative to each other. The position of the holders along the frame of the chair ensure that the holders do not obstruct or otherwise interfere with a regular use of the folding chair.

The stackable, connectable folding chair disclosed herein comprises a support frame, a generally U-shaped front leg frame, a generally U-shaped rear leg frame, a pair of arm rests, a first chair connecting member, one or more first holders, a second chair connecting member, one or more second holders, and one or more straps. The support frame comprises a back support member and a seat member. The back support member is pivotally connected to the seat member. In some embodiments, the back support member of the support frame comprises a generally U-shaped back support frame configured to accommodate and support a backrest. In some embodiments, the seat member of the support frame comprises a seat support frame configured to accommodate and support a seat.

The generally U-shaped front leg frame is pivotally connected proximal to front ends of opposing side bars of the seat member. In some embodiments, the generally U-shaped front leg frame comprises a pair of front legs and a base connecting member. The base connecting member of the generally U-shaped front leg frame is configured to connect lower ends of the pair of front legs to form a U-shape. The generally U-shaped rear leg frame is pivotally connected to lower ends of opposing side bars of the back support member. Although discussed herein as being connected to each other, it should be understood that certain frame members of the chair can be formed as a single tubular frame bent into the desired shape (e.g., such that the side bars extend from the back support member). For example, in some embodiments, the rear leg frame could be formed as a single tubular frame bent into the generally U-shaped configuration. In some embodiments, the rear leg frame could be formed from multiple tubular components coupled together to form the generally U-shaped configuration (e.g., a separate back support member and separate side bars coupled together). In some embodiments, the generally U-shaped rear leg frame comprises a pair of rear legs and the base connecting member. The base connecting member of the generally U-shaped rear leg frame is configured to connect lower ends of the pair of rear legs to form a U-shape. In some embodiments, the stackable, connectable folding chair further comprises a leg locking member operably coupled to each of the lower ends of the opposing side bars of the back support member and to a mid-section of the generally U-shaped rear leg frame. The leg locking member is configured to pivot and lock the generally U-shaped rear leg frame to the back support member in a folded configuration and a deployed configuration of the stackable, connectable folding chair. The proximal ends of the pair of arm rests are pivotally connected to opposing side bars of the back support member.

The first chair connecting member extends rearwardly from a top bar of the back support member. The first holder(s) is attached rearwardly to the first chair connecting member. The first holder(s) is configured to connect (e.g., releasably engage with and couple) to a corresponding top bar of a back support member of another folding chair. The second chair connecting member extends rearwardly from a base connecting member of the generally U-shaped rear leg frame. The second holder(s) is attached rearwardly to the second chair connecting member. The second holder(s) is configured to connect (e.g., releasably engage with and couple) to a corresponding base connecting member of a rear leg frame of the other folding chair. In an embodiment, the second holder(s) is an elongate holder (e.g., dimensioned greater in length than the first holder(s)) configured to connect to the corresponding base connecting member of the rear leg frame of the other folding chair.

The strap(s) is attached to a bottom area of the seat member. In an embodiment, the strap(s) comprises one or more attachment elements configured to attach and secure one or more items, for example, a cooler, a tote bag, an umbrella, etc., to the strap(s). In an embodiment, the stackable, connectable folding chair can include a support pad attached to and suspended from a rear section of a bottom surface of the seat member. The support pad is configured to provide support to a lower back of the user when the user carries the stackable, connectable folding chair in the folded configuration using the strap(s). In an embodiment, the stackable, connectable folding chair can include a lifting handle attached to the top bar of the back support member of the support frame. The lifting handle is configured to be gripped by a user for carrying the stackable, connectable folding chair. The stackable, connectable folding chair is configured for releasable coupling or connection to another adjacently positioned folding chair in a folded configuration and, the assembly can be further releasably coupled or connected to additional folding chairs to form a connected stack of folding chairs configured to be carried and transported by the user. The folding chair can therefore be coupled to only a second folding chair for transport together, or could be used to couple multiple folding chairs together to enable transport of multiple chairs in a convenient, efficient and comfortable manner.

Disclosed herein is also a connection assembly for connecting and stacking a plurality of folding chairs. In an embodiment, the connection assembly comprises one or more first holders and one or more second holders as disclosed above. In another embodiment, the connection assembly comprises a first chair connecting member for rearwardly attaching one or more first holders and a second chair connecting member for rearwardly attaching one or more second holders as disclosed above.

In accordance with embodiments of the present disclosure, an exemplary folding chair is provided. The folding chair includes a support frame comprising a back support member and a seat member. The back support member is pivotally connected to the seat member. The folding chair includes a front leg frame pivotally connected to side bars of the seat member, a rear leg frame pivotally connected to side bars of the back support member, and a pair of arm rests. The folding chair includes a first chair connecting member extending rearwardly from a top bar of the back support member. The folding chair includes one or more first holders attached to the first chair connecting member and extending rearwardly away from the first chair connecting member. The one or more first holders are configured to connect to a corresponding top bar of a back support member of another folding chair. The folding chair includes a second chair connecting member extending from the rear leg frame. The folding chair includes one or more second holders attached to the second chair connecting member and extending rearwardly away from the second chair connecting member. The one or more second holders are configured to connect to a corresponding rear leg frame of the another folding chair.

In some embodiments, the folding chair can include a support pad attached to and suspended from a rear section of a bottom surface of the seat member. The support pad can be configured to provide separation between a lower back of a user and the support frame when the user carries the folding chair using one or more straps attached to the bottom surface of the seat member. The back support member of the support frame can include a generally U-shaped back support frame configured to accommodate and support a backrest. The seat member of the support frame can include a seat support frame configured to accommodate and support a seat.

The front leg frame can be a generally U-shaped front leg frame including a pair of front legs and a base connecting member. The base connecting member can be configured to connect lower ends of the pair of front legs to form a U-shape. The rear leg frame can be a generally U-shaped rear leg frame including a pair of rear legs and the base connecting member. The base connecting member can be configured to connect lower ends of the pair of rear legs to form a U-shape. The one or more second holders can define a width greater than a width of the one or more first holders. The one or more second holders can be configured to connect to a corresponding base connecting member of the rear leg frame of the another folding chair.

The folding chair can include one or more straps attached to a bottom surface of the seat member. The one or more straps allow for wearing and carrying of the folding chair against a lower back of a user. In some embodiments, the one or more straps can include one or more attachment elements configured to attach and secure one or more of a plurality of items to the one or more straps.

In some embodiments, the folding chair can include a leg locking member operably coupled to each of the side bars of the back support member and to a mid-section of the rear leg frame. The leg locking member can be configured to pivot and lock the rear leg frame to the back support member in a folded configuration and a deployed configuration of the folding chair. In some embodiments, the folding chair can include a lifting handle attached to the top bar of the back support member of the support frame. The lifting handle can be configured to be gripped by a user for carrying the folding chair.

The one or more first holders can include at least two first holders, and the one or more second holders can be centrally aligned between the at least two first holders as viewed from the rear of the folding chair. The one or more first holders can include two first holders spaced from each other on opposing sides of the first chair connecting member. A width of each of the first holders is dimensioned smaller than a width of each of the one or more second holders.

The first chair connecting member extends perpendicularly from the top bar of the back support member along a plane substantially parallel to horizontal. The second chair connecting member extends at an upward angle the rear leg frame relative to horizontal such that the one or more second holders extend towards the one or more first holders. In some embodiments, each of the one or more first holders and each of the one or more second holders can define a substantially C-shaped clamp. In some embodiments, the folding chair can include a support pad suspended from a bottom surface of the seat member and configured to be disposed between a lower back of a user and at least a portion of the support frame when the user carries the folding chair on their back in a folded configuration.

In accordance with embodiments of the present disclosure, an exemplary system for connecting and stacking folding chairs is provided. The system includes a plurality of folding chairs. Each of the plurality of folding chairs is capable of being positioned in a folded configuration and a deployed configuration. The plurality of folding chairs are stackable and connectable to each other in the folded configuration. The system includes one or more first holders configured for attachment to a top bar of a back support member of each of the plurality of folding chairs such that the one or more holders extend rearwardly away from the top bar. The one or more first holders of the each of the folding chairs are configured to releasably connect to a corresponding top bar of a back support member of another one of the plurality of folding chairs. The system includes one or more second holders configured for attachment to a rear leg frame of each of the plurality of folding chairs such that the one or more second holders extend rearwardly away from the rear leg frame. The one or more second holders of the each of the folding chairs are configured to releasably connect to a corresponding rear leg frame of the another one of the plurality of folding chairs. Each of the plurality of folding chairs are configured for stacking connection to one another with the one or more first holders and the one or more second holders to form a connected stack of folding chairs configured to be carried and transported by a user.

In accordance with embodiments of the present disclosure, an exemplary connection assembly for stacking and connecting a plurality of folding chairs is provided. The connection assembly includes a first chair connecting member extending rearwardly from a top bar of a back support member of each of the plurality of folding chairs. The connection assembly includes one or more first holders attached to the first chair connecting member and extending rearwardly away from the first chair connecting member. The one or more first holders of the each of the plurality of folding chairs are configured to connect to a corresponding top bar of a back support member of another one of the plurality of folding chairs. The connection assembly includes a second chair connecting member extending from a rear leg frame of the each of the plurality of folding chairs. The connection assembly includes one or more second holders attached to the second chair connecting member and extending rearwardly away from the second chair connecting member. The one or more second holders of the each of the folding chairs are configured to connect to a corresponding rear leg frame of the another one of the plurality of folding chairs. The one or more second holders define a width greater than a width of the one or more first holders, and the one or more second holders are configured to connect to a corresponding base connecting member of the rear leg frame of the another one of the plurality of folding chairs.

BRIEF DESCRIPTION OF THE DRAWINGS

The foregoing summary, as well as the following detailed description of the invention, is better understood when read in conjunction with the appended drawings. For illustrating the embodiments herein, exemplary constructions of the embodiments are shown in the drawings. However, the embodiments herein are not limited to the specific components and structures disclosed herein. The description of a component or a structure referenced by a numeral in a drawing is applicable to the description of that component or structure shown by that same numeral in any subsequent drawing herein. The terms "upper", "lower", "front", "rear", "top", "bottom", "inner", "outer", etc., are based on the orientation or positional relationship shown in the appended drawings, and is only for the convenience of describing the embodiments herein, rather than indicating or implying that the device, component, or structure referenced must have a particular orientation, must be constructed and operated in a particular orientation, and therefore should not be construed as limiting the embodiments herein.

DETAILED DESCRIPTION

Figure 1A:
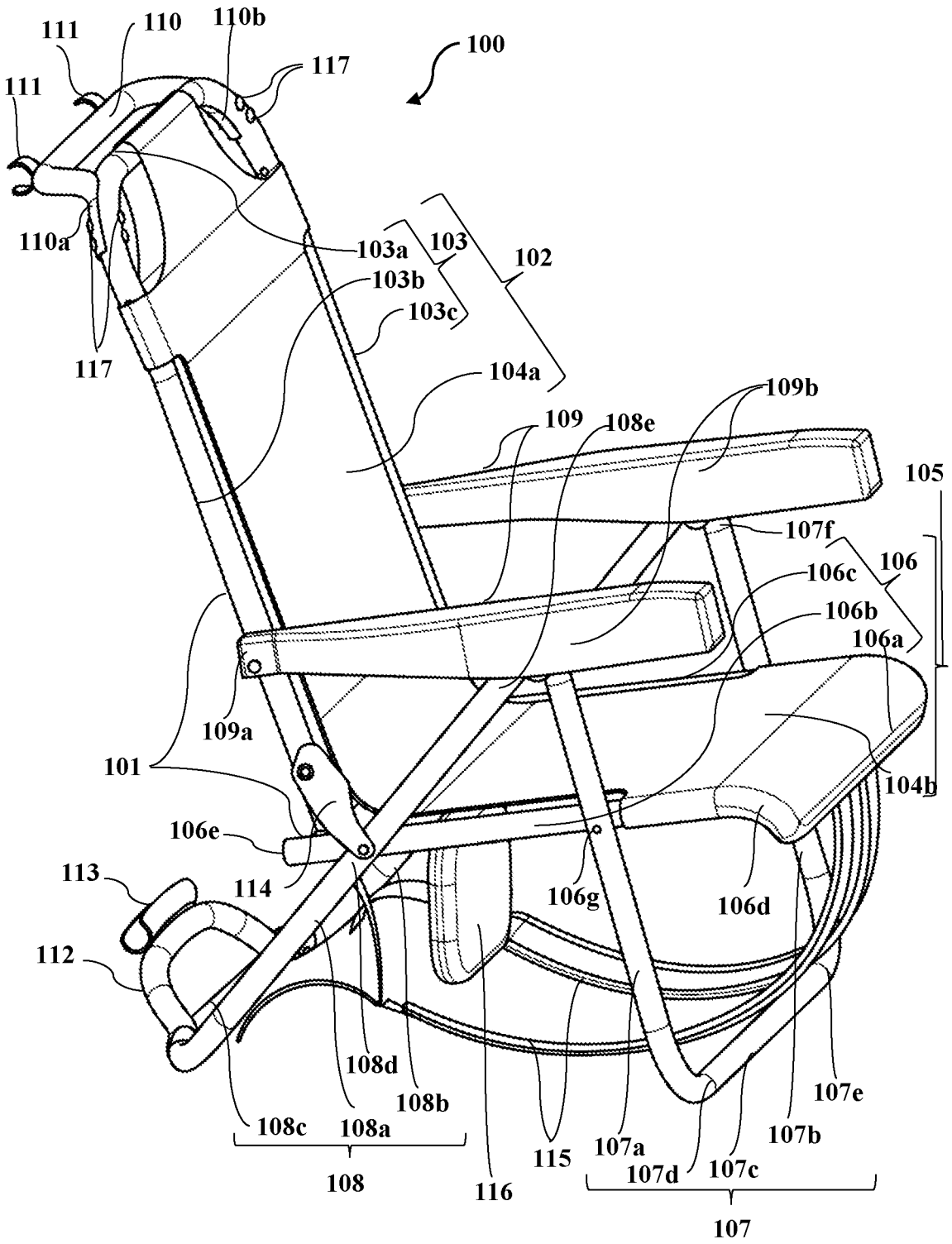
FIG. 1A illustrates a left-side perspective view of an embodiment of a stackable, connectable folding chair in a deployed configuration, showing holders configured to connect another folding chair thereto.
Figure 1B:
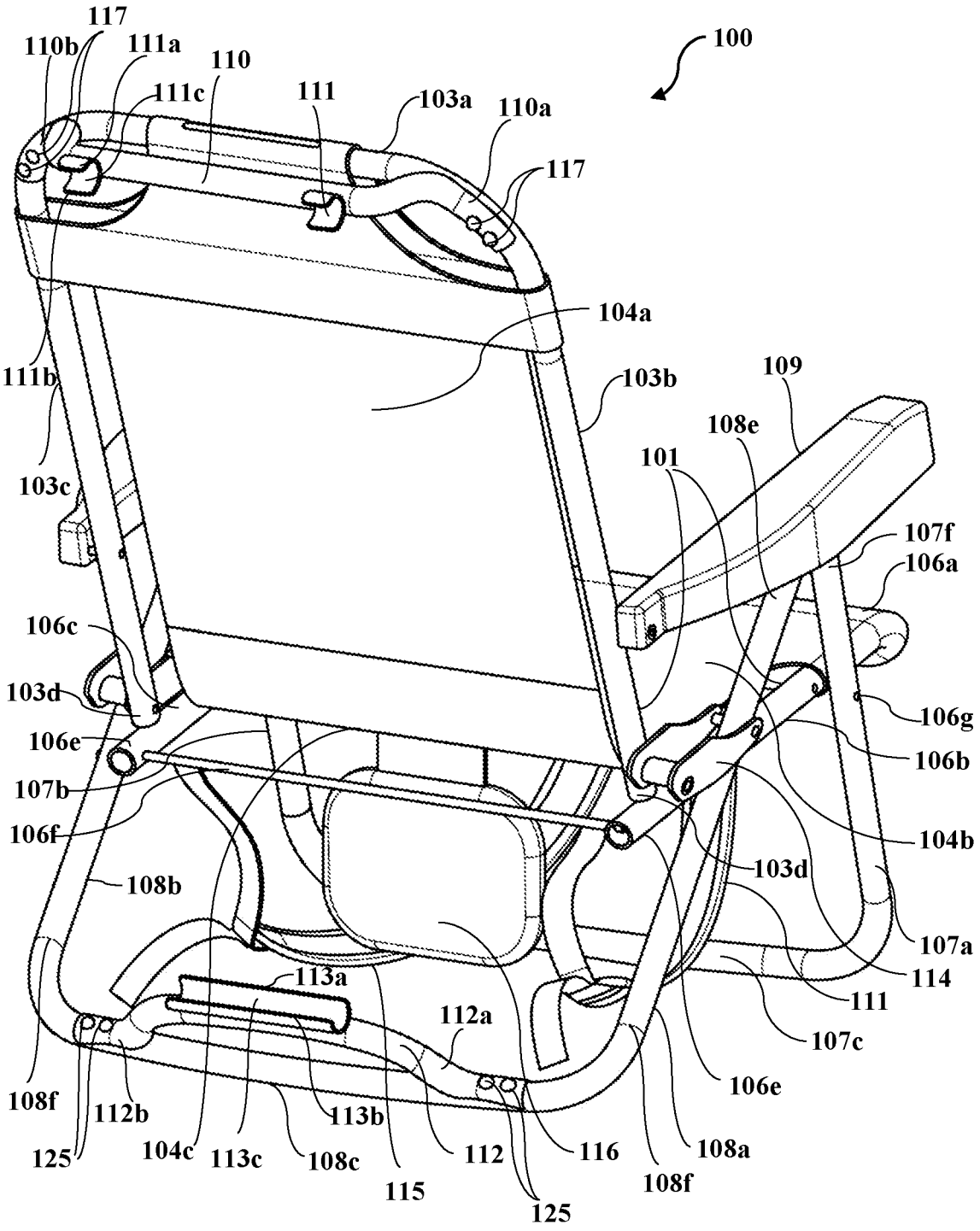
FIG. 1B illustrates a rear perspective view of the embodiment of the stackable, connectable folding chair shown in FIG. 1A, in a deployed configuration.

FIGS. 1A-1B illustrates a left-side perspective view and a rear perspective view, respectively, of an embodiment of a stackable, connectable folding chair 100 in a deployed configuration, showing holders 111 and 113 configured to connect another folding chair 100 thereto. As used herein, "deployed configuration" refers to a configuration of the folding chair 100 when the folding chair 100 is opened and unfolded for use. Also, as used herein, the term "holder" refers to a connection mechanism of any suitable type, for example, a clip, a clamp, a strap, a fastener, or the like, configured to facilitate releasable connection and/or coupling of multiple folding chairs to one another. The holders 111, 113 can thereby be used to engage with the frame of another chair 100 when in the folded configuration, allowing for coupling of the holders 111, 113 to the frame to secure the two or more folded chairs 100 to each other for storage or transport. When the chair 100 is ready for use, the holders 111, 113 can be disengaged and released from the frame of the adjacently disposed chair 100 to facilitate deployment of the chair 100. A detailed discussion of the chair 100 is provided herein. However, the chair 100 can also incorporate one or more features of the chair disclosed in U.S. Pat. No. 11,330,907, which is incorporated by reference in its entirety.

The stackable, connectable folding chair 100 disclosed herein comprises a support frame 101, a generally U-shaped front leg frame 107, a generally U-shaped rear leg frame 108, a pair of arm rests 109, a first chair connecting member 110, one or more first holders 111, a second chair connecting member 112, one or more second holders 113, and one or more straps 115. The support frame 101 comprises a back support member 102 and a seat member 105. The back support member 102 is pivotally connected to the seat member 105. In an embodiment, the back support member 102 of the support frame 101 comprises a generally U-shaped back support frame 103 defined by a top bar 103*a* and opposing side bars 103*b* and 103*c* extending downwardly from opposing sides of the top bar 103*a*. In an embodiment, the top bar 103*a* and the opposing side bars 103*b* and 103*c* of the generally U-shaped back support frame 103 are tubular elements made, for example, of wood, steel, stainless steel, aluminum, or the like. The generally U-shaped back support frame 103 is configured to accommodate and support a backrest 104*a*. The backrest 104*a* is configured to support a user's back when the user sits on the folding chair 100. As used herein, the term "user" refers to a person who uses the folding chair for sitting, relaxation, and other recreational and leisure activities, for example, at a beach, on a deck, poolside, in a backyard, or the like, and who wishes to carry and transport one or more of the folding chairs 100. The backrest 104*a* is made of a sturdy, durable fabric material. The generally U-shaped back support frame 103 and the backrest 104*a* together constitute the back support member 102 of the support frame 101.

In an embodiment, the seat member 105 of the support frame 101 comprises a seat support frame 106 defined by a front bar 106*a*, a rear bar 106*f*, and opposing side bars 106*b* and 106*c* that extend substantially perpendicularly between the bars 106*a*, 106*f*. In an embodiment, the front bar 106*a*, the rear bar 106*f*, and the opposing side bars 106*b* and 106*c* of the seat support frame 106 are tubular elements made, for example, of wood, steel, stainless steel, aluminum, or the like. The front bar 106*a* connects the front ends 106*d* of the opposing side bars 106*b* and 106*c*, and the rear bar 106*f* rearwardly connects the rear ends 106*e* of the opposing side bars 106*b* and 106*c*, to form a generally rectangular-shaped seat support frame 106. In an embodiment, the front bar 106*a*, the rear bar 106*f*, and the opposing side bars 106*b* and 106*c* form a generally square-shaped seat support frame 106. In an embodiment, the diameter of the rear bar 106*f* is substantially less than the diameters of the front bar 106*a* and the opposing side bars 106*b* and 106*c* of the seat support frame 106, and therefore is thinner than the front bar 106*a* and the opposing side bars 106*b* and 106*c* as illustrated in FIG. 1B. The seat support frame 106 is configured to accommodate and support a seat 104*b*. The seat 104*b* is configured to support a user's body when the user sits on the seat member 105 of the folding chair 100. The seat 104*b* is made of a sturdy, durable fabric material. The seat support frame 106 and the seat 104*b* together constitute the seat member 105 of the support frame 101. In an embodiment as illustrated in FIGS. 1A-1B, a single piece of sturdy, durable fabric material is configured to create the backrest 104*a* and the seat 104*b* as a single unit, supported by the back support member 102 and the seat member 105, respectively.

The generally U-shaped front leg frame 107 is pivotally connected proximal to the front ends 106*d* of the opposing side bars 106*b* and 106*c* of the seat member 105. The generally U-shaped front leg frame 107 pivots against the opposing side bars 106*b* and 106*c* of the seat member 105 at pivots points 106*g* illustrated in FIGS. 1A-1B and FIG. 2A. In an embodiment, the generally U-shaped front leg frame 107 comprises a pair of front legs 107*a* and 107*b* and a base connecting member 107*c*. The base connecting member 107*c* of the generally U-shaped front leg frame 107 is configured to connect lower ends 107*d* and 107*e* of the pair of front legs 107*a* and 107*b*, respectively, to form a U-shape. In an embodiment, the pair of front legs 107*a* and 107*b* and the base connecting member 107*c* of the generally U-shaped front leg frame 107 are tubular elements made, for example, of wood, steel, stainless steel, aluminum, etc., connected to form a continuous generally U-shaped front leg frame 107.

The generally U-shaped rear leg frame 108 is pivotally connected to lower ends 103*d* of the opposing side bars 103*b* and 103*c* of the back support member 102 through a leg locking member 114. The rear leg frame 108 is also pivotally connected relative to the side bars 106*b*, 106*c* of the seat member 105. In an embodiment, the generally U-shaped rear leg frame 108 comprises a pair of rear legs 108*a* and 108*b* and a base connecting member 108*c* extending perpendicularly between the rear legs 108*a*, 108*b*. The base connecting member 108*c* of the generally U-shaped rear leg frame 108 is configured to connect lower ends 108*f* of the pair of rear legs 108*a* and 108*b* to form a U-shape. In an embodiment, the pair of rear legs 108*a* and 108*b* and the base connecting member 108*c* of the generally U-shaped rear leg frame 108 are tubular elements made, for example, of wood, steel, stainless steel, aluminum, or the like, connected to form a continuous U-shaped rear leg frame 108. The proximal ends 109*a* of the pair of arm rests 109 are pivotally connected to the opposing side bars 103*b* and 103*c* of the back support member 102. Furthermore, upper ends 107*f* and 108*e* of the generally U-shaped front leg frame 107 and the generally U-shaped rear leg frame 108, respectively, are pivotally connected to bottom mid-sections 109*b* of the pair of arm rests 109. The pair of arm rests 109 provides support to the user's arms when the user sits on the stackable, connectable folding chair 100. In an embodiment, the stackable, connectable folding chair 100 further comprises a leg locking member 114 operably coupled to each of the lower ends 103*d* of the back support member 102 and to a mid-section 108*d* of the generally U-shaped rear leg frame 108. The leg locking member 114 is configured to pivot and lock the generally U-shaped rear leg frame 108 to the back support member 102 in a folded configuration and a deployed configuration of the stackable, connectable folding chair 100. The leg locking member 114 therefore allows for pivoting of the different frame components of the chair 100, while simultaneously assisting with maintaining the chair 100 in the respective folded and deployed configurations. In some embodiments, the leg locking member 114 can include bars or flanges that act as stops to prevent further pivoting of the frame components of the chair 100, thereby setting the limits for pivoting and establishing the proper folded and deployed configurations. As used herein, "folded configuration" refers to a configuration of the folding chair 100 when the folding chair 100 is closed and folded for storage and transportation. When the stackable, connectable folding chair 100 is unfolded into the deployed configuration, the generally U-shaped front leg frame 107 and the generally U-shaped rear leg frame 108 support the stackable, connectable folding chair 100 on a ground surface, for example, on a deck, on sand at a beach, in a backyard, or the like.

The first chair connecting member 110 extends rearwardly from the top bar 103*a* of the back support member 102. The connecting member 110 can define an outwardly extending, U-shaped tube member that secures to the back support frame 103 and extends substantially perpendicularly from the back support frame 103. In an embodiment, the first chair connecting member 110 is of a general arcuate shape. Opposing ends 110*a* and 110*b* of the first chair connecting member 110 are attached to the top bar 103*a* (or downwardly curving portions of the top bar 103*a*) of the back support member 102 using fasteners 117, for example, screws, bolts, or the like. In some embodiments, the opposing ends 110*a*, 110*b* can define a curved or U-shaped configuration complementary to the outer surface of the top bar 103*a* such that the opposing ends 110*a*, 110*b* can be positioned and coupled substantially flush against the top bar 103*a*. As illustrated in FIGS. 1A-1B, two first holders 111 are attached rearwardly to the first chair connecting member 110. The chair 100 includes two holders 111 spaced from each other on opposing sides of the connecting member 110 to ensure a secure connection is made when coupling to another chair 100. In some embodiments, the holders 111 can be secured to the connecting member 110 using fasteners (not shown) engaged with a threaded opening formed in the connecting member 110 to allow for replacement of the holders 111 if damage occurs. In some embodiments, the connecting member 110 can include a slotted opening and the rear of each holder 111 can include a flange such that insertion of the flange and rotation of the holder 111 locks the holder 111 relative to the connecting member 110 without the use of fasteners. In some embodiments, the rear of each holder 111 can include tabs that snap into complementary openings in the connecting member 110 to secure the holder 111 to the connecting member 110. The holders 111 are fixed in position (e.g., cannot rotate relative to the connecting member 110) and are oriented to face away from the top bar 103*a*.

Figure 3A:
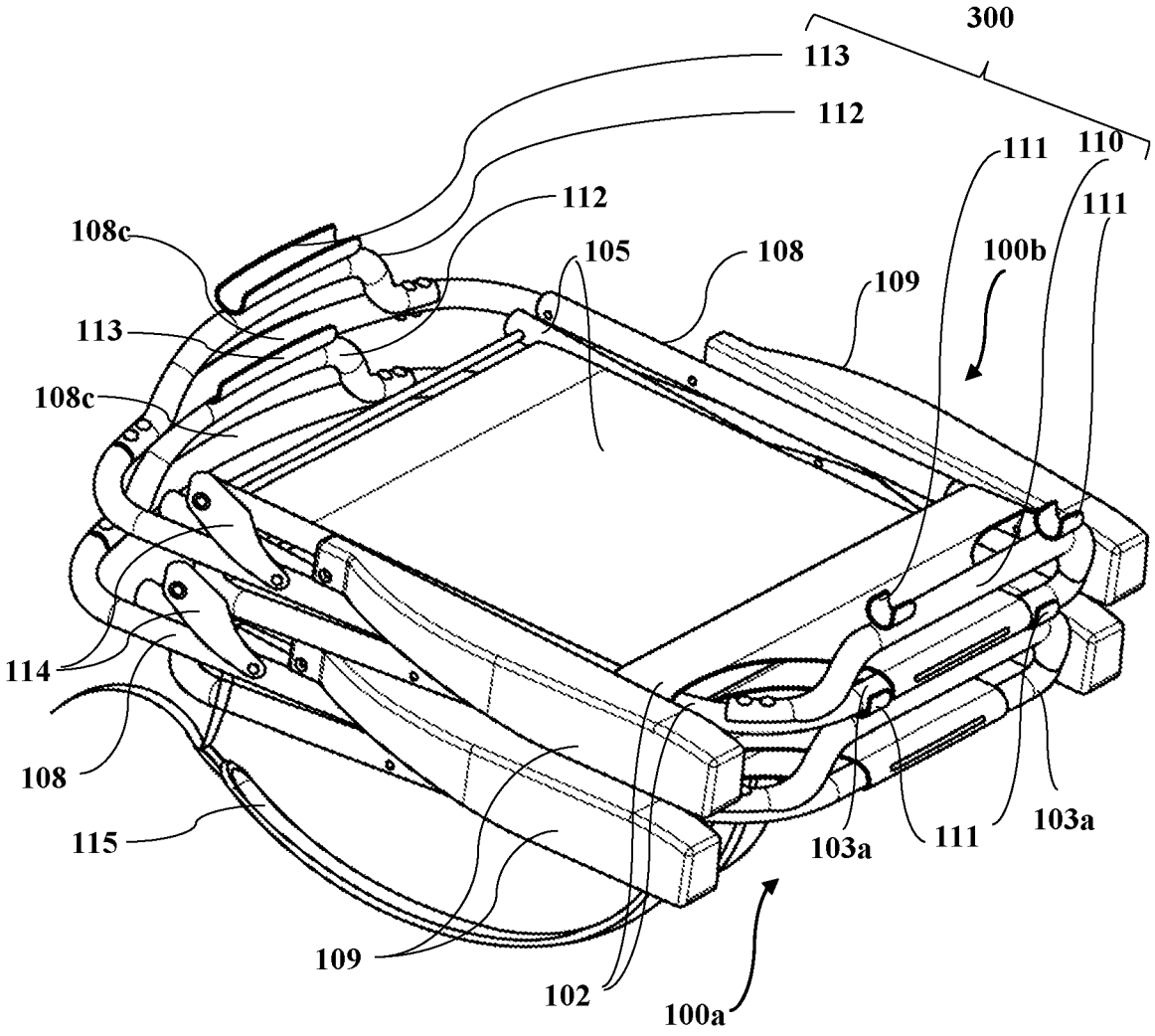
FIG. 3A illustrates a perspective view showing an embodiment of the stackable, connectable folding chair in a folded configuration, connected to another stackable, connectable folding chair in a folded configuration, via the holders.
Figure 3B:
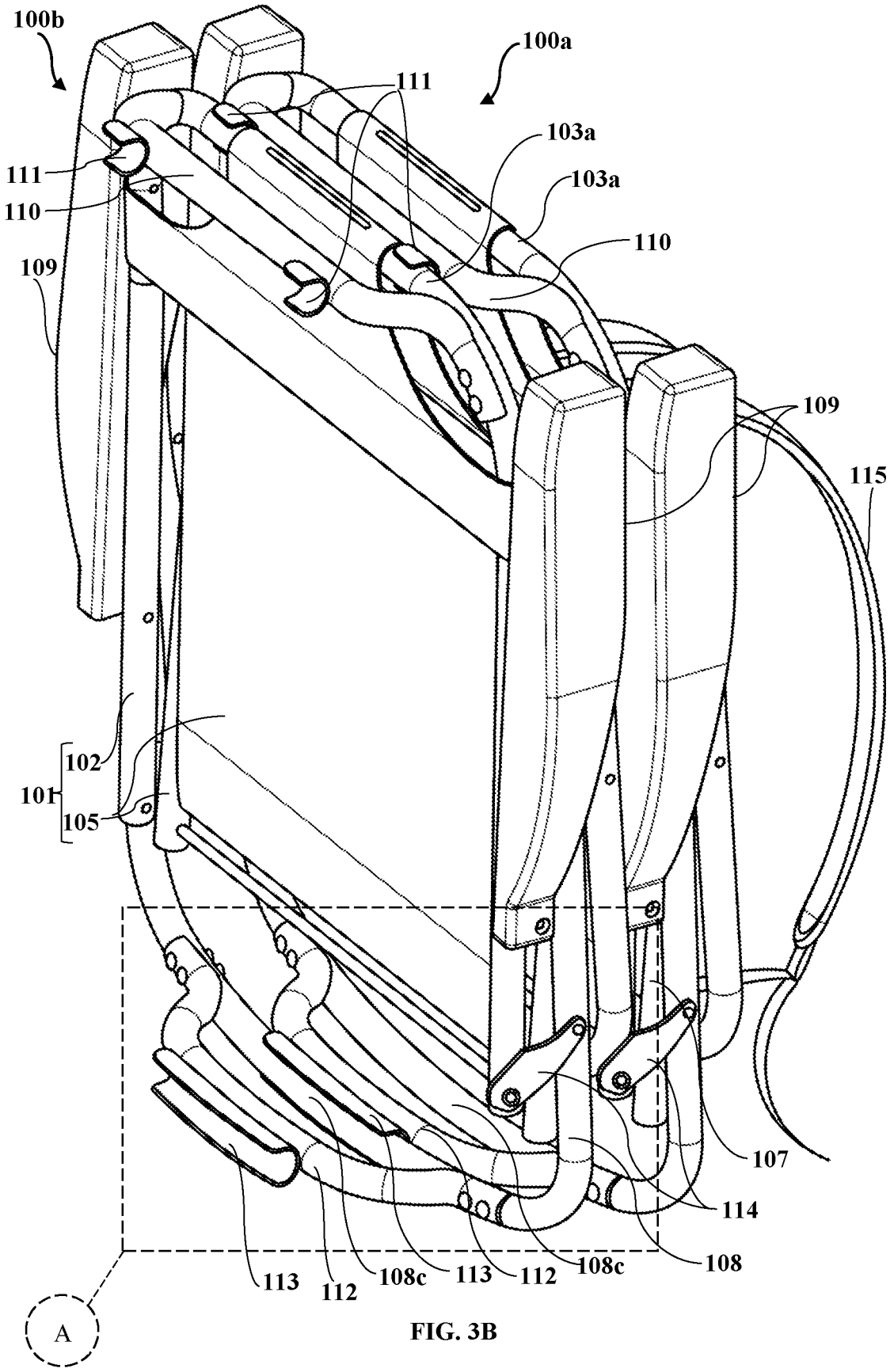
FIG. 3B illustrates a left-side, rear perspective view showing the embodiment of the stackable, connectable folding chair in a folded configuration shown in FIG. 3A, connected to another stackable, connectable folding chair in a folded configuration, via the holders.

The first holders 111 are configured to connect to a corresponding top bar 103*a* of a back support member 102 of another folding chair 100*b* as illustrated in FIGS. 3A-3B. In an embodiment, the first holders 111 are configured as curved, general C-shaped holders, for example, C-shaped clips, clamps, or the like, configured to clasp and hold the top bar 103*a* of the back support member 102 of another folding chair 100*b*. In an embodiment as illustrated in FIG. 1B, each first holder 111 comprises opposing jaws 111*a* and 111*b* defining a central slot or opening 111*c* therebetween. The central opening 111*c* is sized to receive the top bar 103*a* of the other folding chair 100*b*, while the opposing jaws 111*a* and 111*b* are flexible yet biased inwardly such that the opposing jaws 111*a* and 111*b* deform to receive the top bar 103*a* and then resiliently act upon the received top bar 103*a* to secure the top bar 103*a* within the central opening 111*c* of the first holder 111. The jaws 111*a*, 111*b* can therefore be flexed outwards from each other during inserting of the top bar 103*a* through the opening 111*c*, and bias back into their normal position to clamp around at least a portion of the top bar 103*a*. In some embodiments, the holders 111 can be fabricated from a plastic material that provides sufficient flexibility for repetitive engagement and disengagement with the top bar 103*a* during coupling of chairs 100 together, while also providing sufficient rigidity/strength to prevent breakage of the holder 111 after repetitive use.

The second chair connecting member 112 extends rearwardly from the base connecting member 108*c* of the generally U-shaped rear leg frame 108. In an embodiment, the second chair connecting member 112 is of a general arcuate shape. Opposing ends 112*a* and 112*b* of the second chair connecting member 112 are attached to the base connecting member 108*c* of the generally U-shaped rear leg frame 108 using fasteners 125, for example, screws, bolts, or the like. The connecting member 112 can define an outwardly extending, U-shaped tube member that secures to the rear leg frame 108 and extends substantially perpendicularly from the rear leg frame 108. In some embodiments, the opposing ends 112*a*, 112*b* can define a curved or U-shaped configuration complementary to the outer surface of the rear leg frame 108 such that the opposing ends 112*a*, 112*b* can be positioned and coupled substantially flush against the rear leg frame 108. In the deployed configuration of the chair 100, the connecting member 112 extends at an upward angle from the rear leg frame 108 relative to horizontal. The second holder(s) 113 is attached rearwardly to the second chair connecting member 112. The overall length/width of the holder 113 is dimensioned greater than the length/width of the holders 111, allowing for a single elongated holder 113 to be used. The use of a single holder 113 results in a connecting member 112 that is dimensioned less in width than the connecting member 110. When viewed from the rear of the chair 100, the holder 113 is centrally aligned between and below the holders 111, ensuring a secure connection is made when coupling to another chair 100. In some embodiments, the holder 113 can be secured to the connecting member 112 using fasteners (not shown) engaged with a threaded opening formed in the connecting member 112 to allow for replacement of the holder 113 if damage occurs. In some embodiments, the connecting member 112 can include a slotted opening and the rear of each holder 113 can include a flange such that insertion of the flange and rotation of the holder 113 locks the holder 113 relative to the connecting member 112 without the use of fasteners. In some embodiments, the rear of the holder 113 can include tabs that snap into complementary openings in the connecting member 112 to secure the holder 113 to the connecting member 112. The holder 113 is fixed in position (e.g., cannot rotate relative to the connecting member 112) and is oriented to face away from the connecting member 108*c*.

Figure 3C:
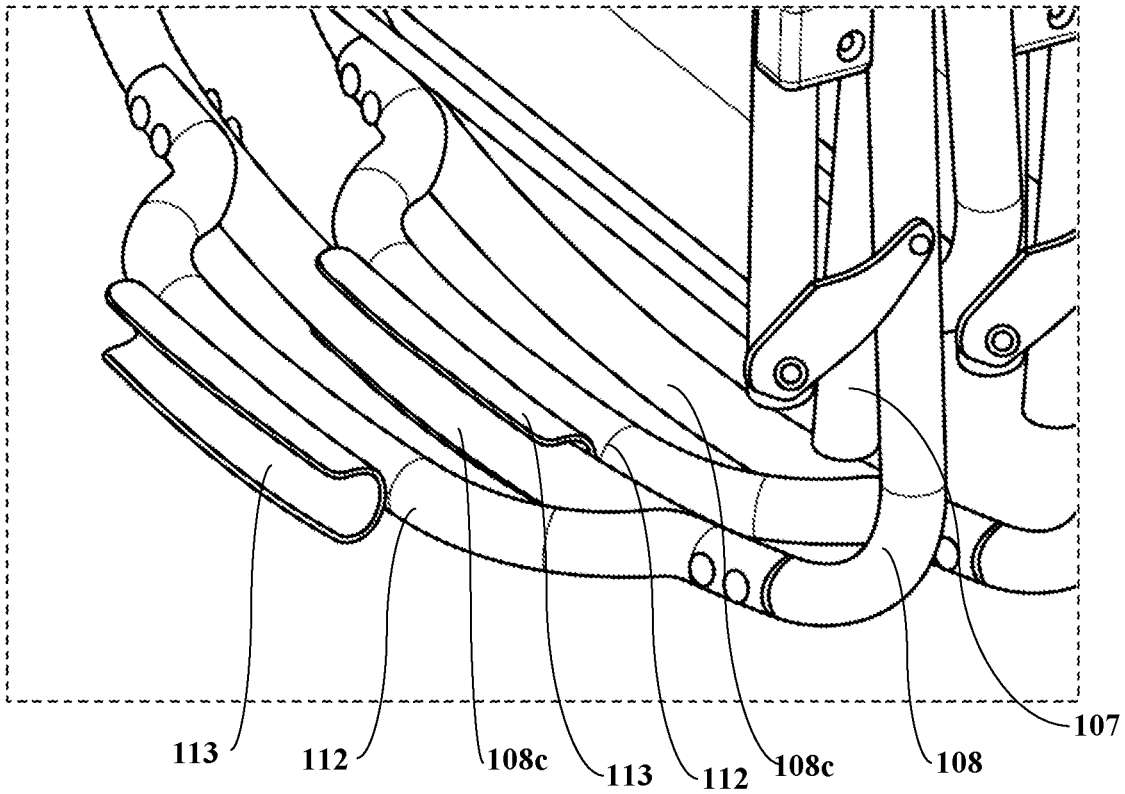
FIG. 3C illustrates an enlarged, left-side perspective view of a section marked A in FIG. 3B, showing an elongate holder of one stackable, connectable folding chair in a folded configuration, connected to a corresponding base connecting member of a rear leg frame of another folding chair in a folded configuration.

The second holder(s) 113 is configured to connect to a corresponding base connecting member 108*c* of a rear leg frame 108 of another folding chair 100*b* as illustrated in FIGS. 3A-3C. In an embodiment, the second holder(s) 113 is an elongate holder configured to connect to the corresponding base connecting member 108*c* of the rear leg frame 108 of another folding chair. In an embodiment, the elongate holder 113 has a curved, general C-shaped cross-section and is configured to clasp and hold the base connecting member 108*c* of the rear leg frame 108 of another folding chair 100*b*. In an embodiment as illustrated in FIG. 1B, the second holder 113 comprises opposing jaws 113*a* and 113*b* defining a central slot or opening 113*c* therebetween. The central opening 113*c* is sized to receive the base connecting member 108*c* of the rear leg frame 108 of the other folding chair, while the opposing jaws 113*a* and 113*b* are flexible yet biased inwardly such that the opposing jaws 113*a* and 113*b* deform to receive the base connecting member 108*c* and then resiliently act upon the received base connecting member 108*c* to secure the base connecting member 108*c* within the central opening 113*c* of the second holder 113. The jaws 113*a*, 113*b* can therefore be flexed outwards from each other during inserting of the connecting member 108*c* through the opening 113*c*, and bias back into their normal position to clamp around at least a portion of the connecting member 108*c*. In some embodiments, the holder 113 can be fabricated from a plastic material that provides sufficient flexibility for repetitive engagement and disengagement with the connecting member 108*c* during coupling of chairs 100 together, while also providing sufficient rigidity/strength to prevent breakage of the holder 113 after repetitive use.

In an embodiment, the first holders 111 and the second holder(s) 113 together constitute a connection assembly 300 for connecting and stacking multiple folding chairs 100 as disclosed in the descriptions of FIGS. 3A-3C and FIG. 4. In another embodiment, the first chair connecting member 110 along with the first holders 111 and the second chair connecting member 112 along with the second holder(s) 113 constitute a connection assembly 300 for connecting and stacking multiple folding chairs 100 as disclosed in the descriptions of FIGS. 3A-3C and FIG. 4. In an embodiment (not shown), additional connectors, for example, clips, or additional holders are attachable to the first chair connecting member 110 and the second chair connecting member 112 for removably securing additional items to the stackable, connectable folding chair 100.

Figure 2A:
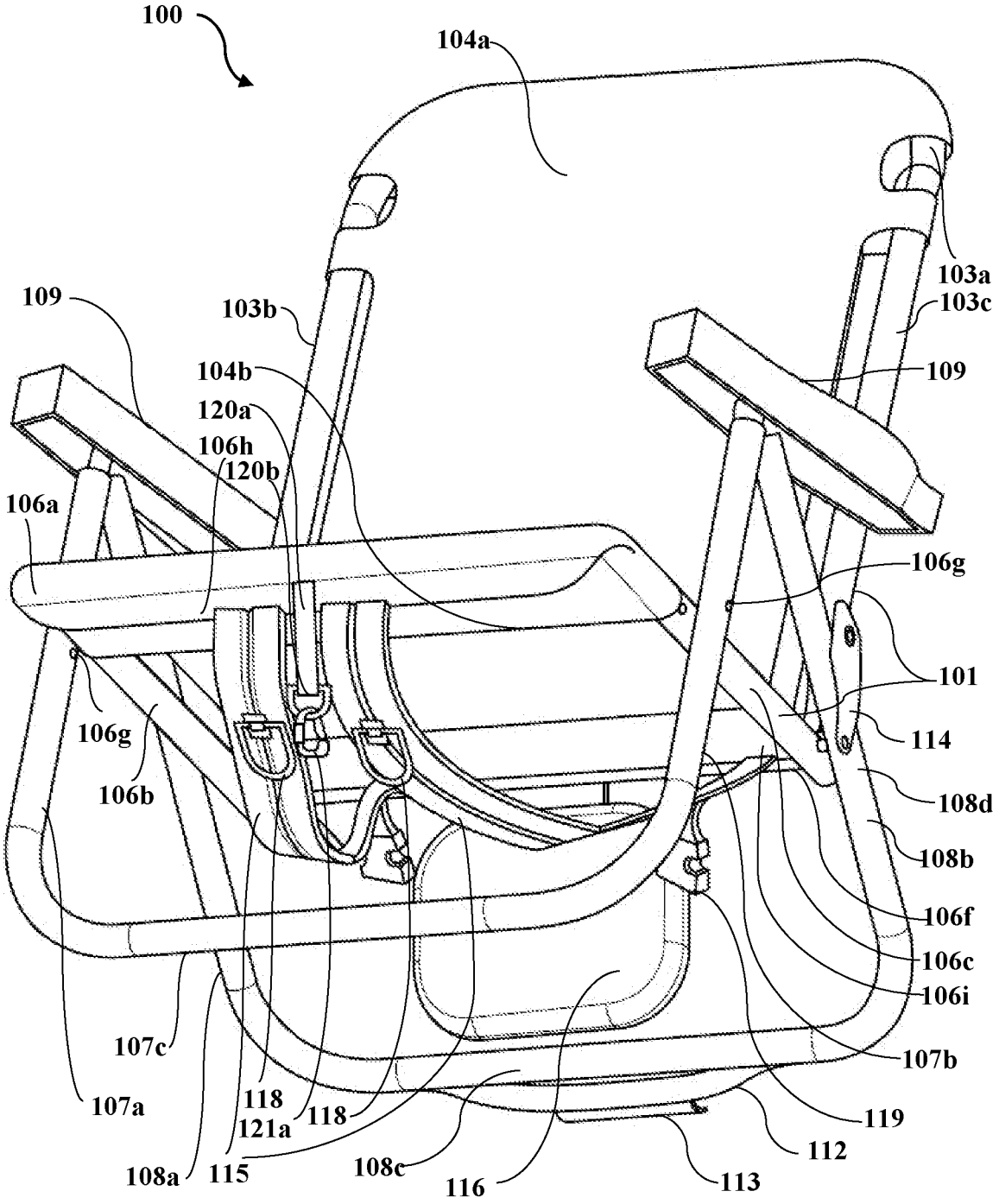
FIG. 2A illustrates a front, bottom perspective view of the embodiment of the stackable, connectable folding chair shown in FIGS. 1A-1B, in a deployed configuration, showing straps with attachment elements attached to bottom areas of a seat member.
Figure 2B:
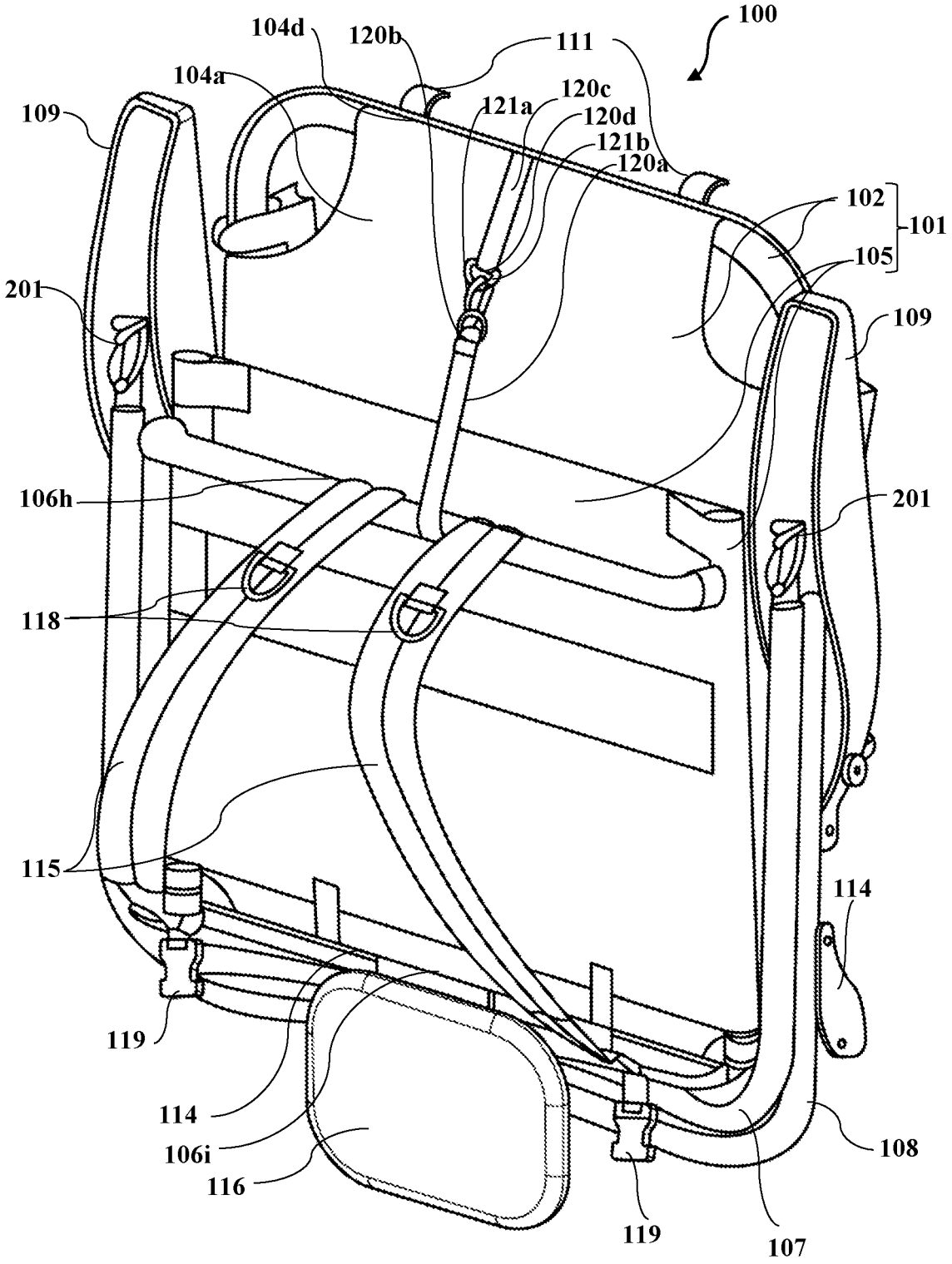
FIG. 2B illustrates a front perspective view of the embodiment of the stackable, connectable folding chair shown in FIG. 2A, in a folded configuration.

In an embodiment, two straps 115 are attached to bottom areas 106*h* and 106*i* of the seat member 105 as illustrated in FIGS. 2A-2B, such that the straps 115 extend from or near the front of the chair 100 to at or near the rear of the chair 100 of the seat member 105. The straps 115 are configured to be worn over the user's shoulders to carry the stackable, connectable folding chair 100 in a folded configuration against the user's back. The straps 115 allow the user to wear the entire apparatus, that is, a stack of multiple folding chairs 100 on their back and at least one additional item 701, for example, a cooler, on the front as disclosed in the description of FIG. 7. In some embodiments, the straps 115 can be fabricated from a fabric or woven material to provide comfort and flexibility for the user. The straps 115 can be adjustable to allow for tightening or loosening the loops formed by the straps 115 depending on the side of the user.

Figure 4:
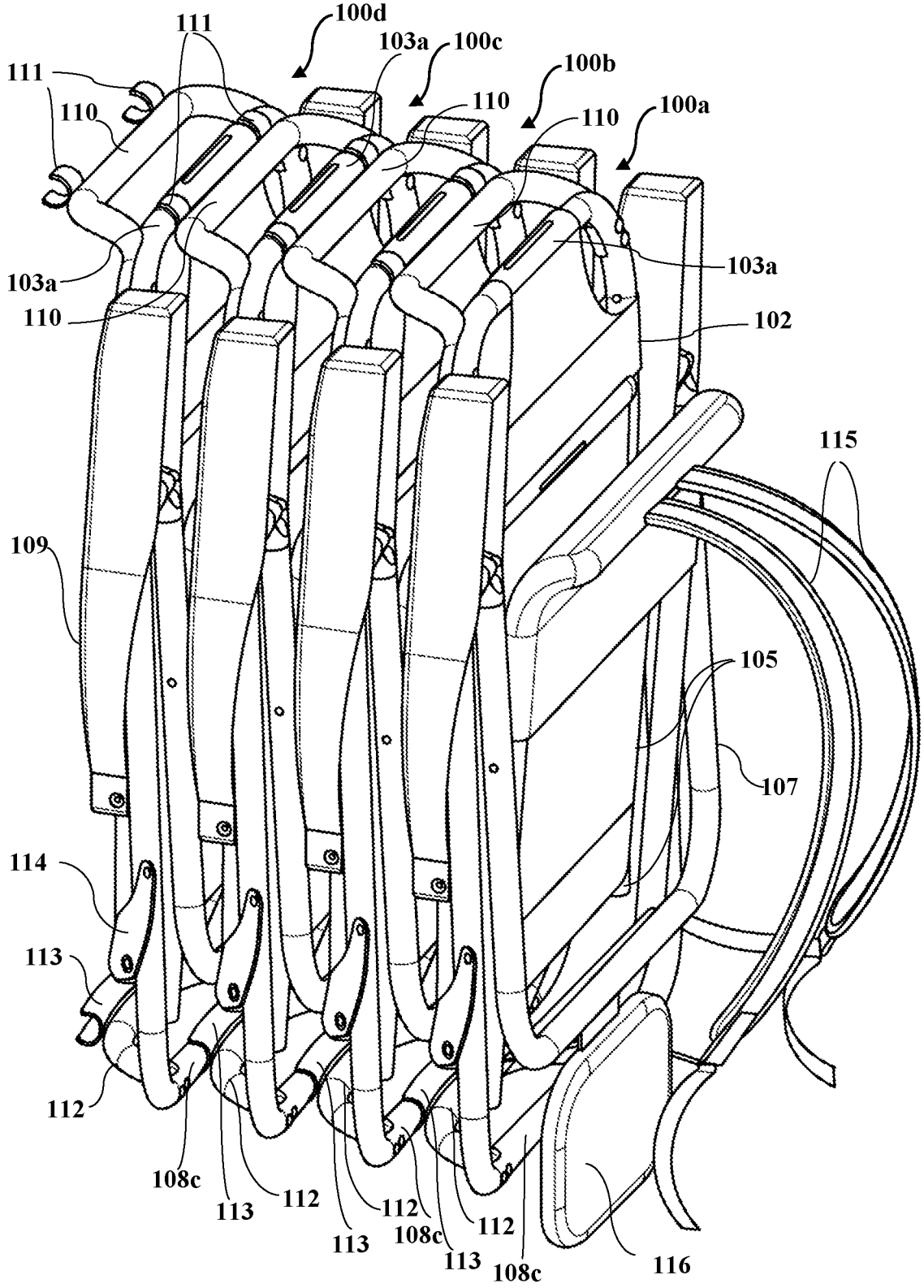
FIG. 4 illustrates a left-side, front perspective view showing a stack of folding chairs in a folded configuration, connected to each other via corresponding holders.

In some embodiments, the stackable, connectable folding chair 100 can include a support pad 116 attached to and suspended from a rear section 104*c* of a bottom surface of the seat member 105. In an embodiment, the support pad 116 is a cushioning member stitched to the fabric at the rear section 104*c* of the seat 104*b*. The support pad 116 is configured to provide support to the user's lower back when the user carries the stackable, connectable folding chair 100 using the straps 115. For example, in some embodiments, the bottom of the seat member 105 can include VELCRO® or other attachment means for securing the support pad 116 to the bottom of the seat member 105 when the chair 100 is in the deployed configuration. When the chair 100 is in the folded configuration, the support pad 116 can swing out into the position shown in FIG. 2B such that the support pad 116 covers at least some of the frame members of the chair 100. In such position, when the user wears the chair 100 on their back using the straps 115, the support pad 116 is positioned between the user's back and the frame components of the chair 100, ensuring improved comfort to the user. The stackable, connectable folding chair 100 disclosed herein is configured for connection to another folding chair and in turn to another one or more folding chairs to form a connected stack of folding chairs 100*a*, 100*b*, 100*c*, and 100*d* as illustrated in FIG. 4, configured to be carried and transported by the user.

FIG. 2A illustrates a front, bottom perspective view of the embodiment of the stackable, connectable folding chair 100 shown in FIGS. 1A-1B, in a deployed configuration, showing straps 115 with attachment elements 118 and 121 attached to bottom areas 106*h* and 106*i* of the seat member 105. Although specific attachment elements 118, 121 are discussed herein, it should be understood that a variety of attachment elements, such as rings, hooks, clasps, or the like, could be attached to the straps 115 and/or the bottom of the seat member 105 to allow for attachment of external items to the chair 100 during use. The seat member 105 is defined by a generally rectangular- or square-shaped seat support frame 106 as illustrated in FIGS. 1A-1B, comprising the front bar 106*a*, the opposing side bars 106*b* and 106*c*, and the rear bar 106*f*, and by the seat 104*b* accommodated within the seat support frame 106. The straps 115 are attached to the bottom areas 106*h* and 106*i* of the seat 104*b*. In an embodiment, the straps 115 are adjustable straps comprising slide adjusters or other mechanisms configured to adjust the length of the straps 115 for an improved fit.

In an embodiment, the straps 115 comprise one or more attachment elements 118, for example, D-rings, clips, buckles, hooks, loops, or other anchor elements, configured to attach and secure one or more items, for example, a cooler, a tote bag, an umbrella, or the like, to the straps 115. The attachment elements 118, for example, the D-rings, receive and secure additional straps (not shown) to the main straps 115, for attaching and securing additional items to the straps 115. In an embodiment, the stackable, connectable folding chair 100 further comprises a supplementary strap 120*a* configured to fasten the seat member 105 to the back support member 102 of the support frame 101, when the stackable, connectable folding chair 100 is in a folded configuration as illustrated in FIG. 2B. In an embodiment, a connector 121*a*, for example, a carabiner, a clasp, a clip, a buckle, or the like, is connected to a lower end 120*b* of the supplementary strap 120*a* for fastening the seat member 105 to the back support member 102 of the support frame 101 when the stackable, connectable folding chair 100 is in the folded configuration. In another embodiment, additional fasteners of any type, for example, buckles 119, configured to be attached at any location along the length of the straps 115 to further secure accessory and other items to the front side of the user's straps 115 for improved weight distribution when the user carries the stackable, connectable folding chair 100. The additional fasteners, for example, the buckles 119, are configured to releasably receive like fasteners on an accessory item or accessory item attachment strap.

FIG. 2B illustrates a front perspective view of the embodiment of the stackable, connectable folding chair 100 shown in FIG. 2A, in a folded configuration. In an embodiment, the stackable, connectable folding chair 100 further comprises a supplementary strap 120*c* stitched or otherwise connected to an upper edge 104*d* of the backrest 104*a*. A ring element 121*b* is attached to a lower end 120*d* of the supplementary strap 120*c*. The connector 121*a*, for example, a carabiner, at the lower end 120*b* of the supplementary strap 120*a* is configured to connect to the ring element 121*b* at the lower end 120*d* of the supplementary strap 120*c* for fastening the seat member 105 to the back support member 102 of the support frame 101, when the stackable, connectable folding chair 100 is in the folded configuration. The connection of the supplementary straps 120*a* and 120*c* by the connectors 121*a* and 121*b* secures and maintains the stackable, connectable folding chair 100 in the folded configuration. FIG. 2B also illustrates the attachment elements 118 and the buckles 119 of the straps 115, the support pad 116 suspended from a bottom area 106*i* of the seat member 105, and the pivot connection of the generally U-shaped front leg frame 107 and the generally U-shaped rear leg frame 108 to the pair of arm rests 109.

FIGS. 3A-3B illustrate a perspective view and a left-side, rear perspective view, respectively, showing an embodiment of the stackable, connectable folding chair 100*a* in a folded configuration, connected to another stackable, connectable folding chair 100*b* in a folded configuration, via the holders 111 and 113. As illustrated in FIGS. 3A-3B, the connection assembly 300 comprising the first chair connecting member 110, the first holders 111, the second chair connecting member 112, and the second holder(s) 113 are configured for stacking and connecting multiple folding chairs, for example, two folding chairs 100*a* and 100*b*. The connection assembly 300 allows multiple folding chairs to be secured together in such a way that facilitates transportation by a user using two or more straps 115. The first holders 111 attached to the first chair connecting member 110 that extends rearwardly from the top bar 103*a* of the back support member 102 of the folding chair 100*a*, connect to a corresponding top bar 103*a* of the back support member 102 of the other folding chair 100*b* as illustrated in FIGS. 3A-3B. Furthermore, the second, elongate holder 113 attached to the second chair connecting member 112 that extends rearwardly from the base connecting member 108*c* of the rear leg frame 108 of the folding chair 100*a*, connects to the corresponding base connecting member 108*c* of the rear leg frame 108 of the other folding chair 100*b* as illustrated in FIGS. 3A-3B. The triangular-shaped distribution or positioning of the holders 111, 113 relative to each other ensures a distributed connection of the chairs 100*a*, 100*b* to each other, preventing or minimizing pivoting and movement of the chairs 100*a*, 100*b* once the holders 111, 113 have been engaged. The first holders 111 and the second elongate holder 113 of the folding chair 100*a*, therefore, connect and hold the other folding chair 100*b* against the folding chair 100*a* to form a stack that can be easily carried and transported by a user using the straps 115. In an embodiment, the holders 111 and 113 are removably attached to the first and second chair connecting members 110 and 112, respectively, using fasteners, for example, screws, flanges, a snap connection, or the like. In an embodiment, the holders 111 and 113 are replaceable to allow for fixing of damage that may occur to the holders 111, 113 during use.

FIG. 3C illustrates an enlarged, left-side perspective view of a section marked A in FIG. 3B, showing an elongate holder 113 of one stackable, connectable folding chair 100*a* in a folded configuration, connected to a corresponding base connecting member 108*c* of a rear leg frame 108 of another folding chair 100*b* in a folded configuration.

FIG. 4 illustrates a left-side, front perspective view showing a stack of folding chairs 100*a*, 100*b*, 100*c*, and 100*d* in a folded configuration, connected to each other via corresponding holders 111 and 113. As illustrated in FIG. 4, four folding chairs 100*a*, 100*b*, 100*c*, and 100*d* are folded from their deployed configuration to the folded configuration. The first holders 111 and the second elongate holder 113 of the first folding chair 100*a* connect and hold a second folding chair 100*b* against the first folding chair 100*a* as disclosed in the description of FIGS. 3A-3B. Similarly, the first holders 111 and the second elongate holder 113 of the second folding chair 100*b* connect and hold a third folding chair 100*c* against the second folding chair 100*b*. Similarly, the first holders 111 and the second elongate holder 113 of the third folding chair 100*c* connect and hold a fourth folding chair 100*d* against the third folding chair 100*c*. The connection of the folding chairs 100*a*, 100*b*, 100*c*, and 100*d* as disclosed above form a stack that can be easily carried and transported by a user using the straps 115. Similarly, any number of folding chairs can be connected together to form a stack that can be easily carried and transported by the user using the straps 115.

In the engaged and connected configuration of FIG. 4, the chairs 100*a*, 100*b*, 100*c*, 100*d* can generally align along the same plane such that the top and bottom frame members of the chairs 100*a*, 100*b*, 100*c*, 100*d* are substantially uniformly disposed along planes parallel to horizontal. In some embodiments, when engaged and connected to each other, the top and bottom frame members of the chairs 100*a*, 100*b*, 100*c*, 100*d* can be disposed along a plane angled relative to horizontal, e.g., the top frame member of the chair 100*b* is disposed slightly higher than the top frame member of the chair 100*a*, the top frame member of the chair 100*c* is disposed slightly higher than the top frame member of the chair 100*b*, and so forth.

Figure 5A:
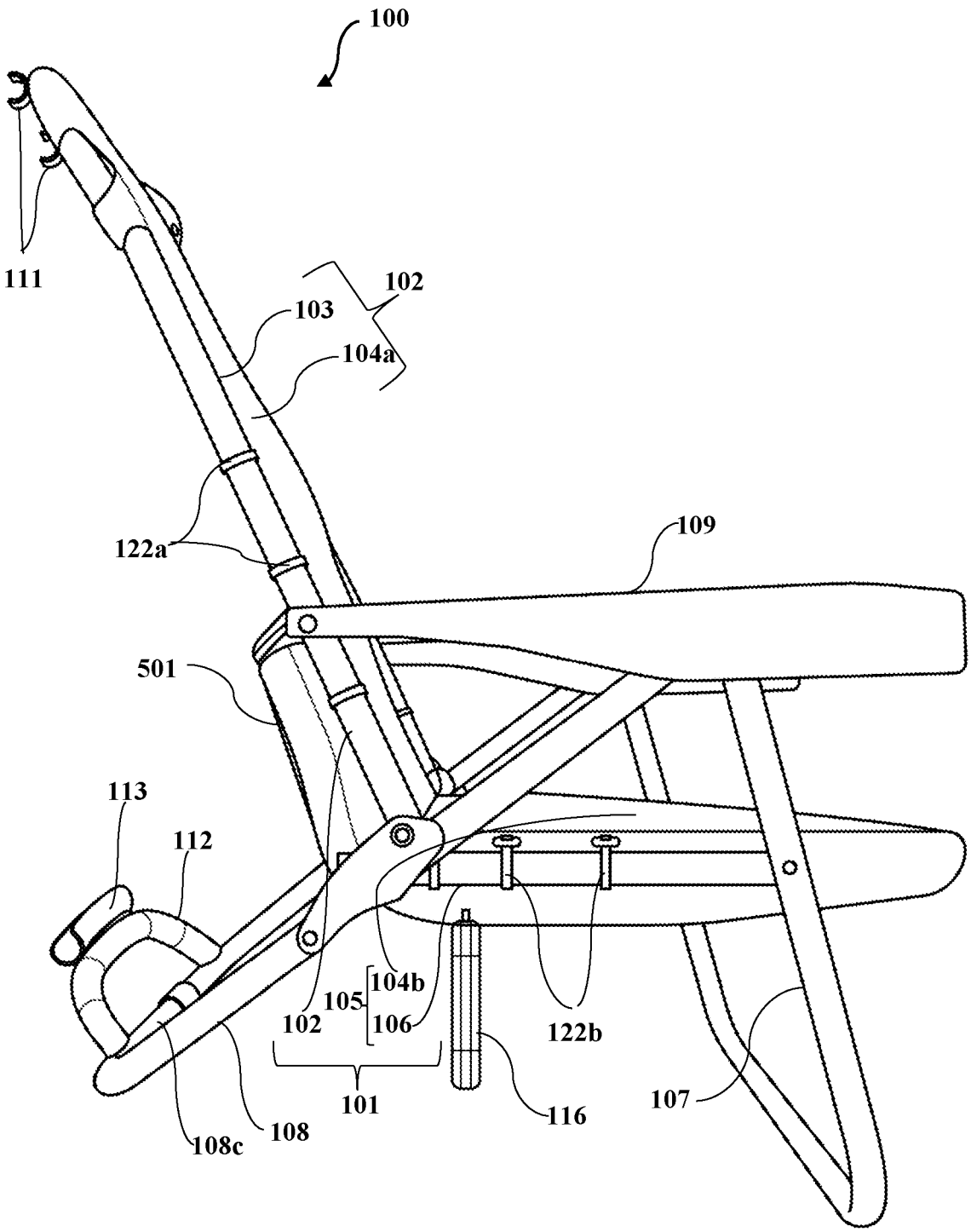
FIGS. 5A-5C illustrate left-side perspective views of another embodiment of the stackable, connectable folding chair, showing an operation of the stackable, connectable folding chair from a deployed configuration (FIG. 5A) to a partially folded configuration (FIG. 5B) to a folded configuration (FIG. 5C).
Figure 5B:
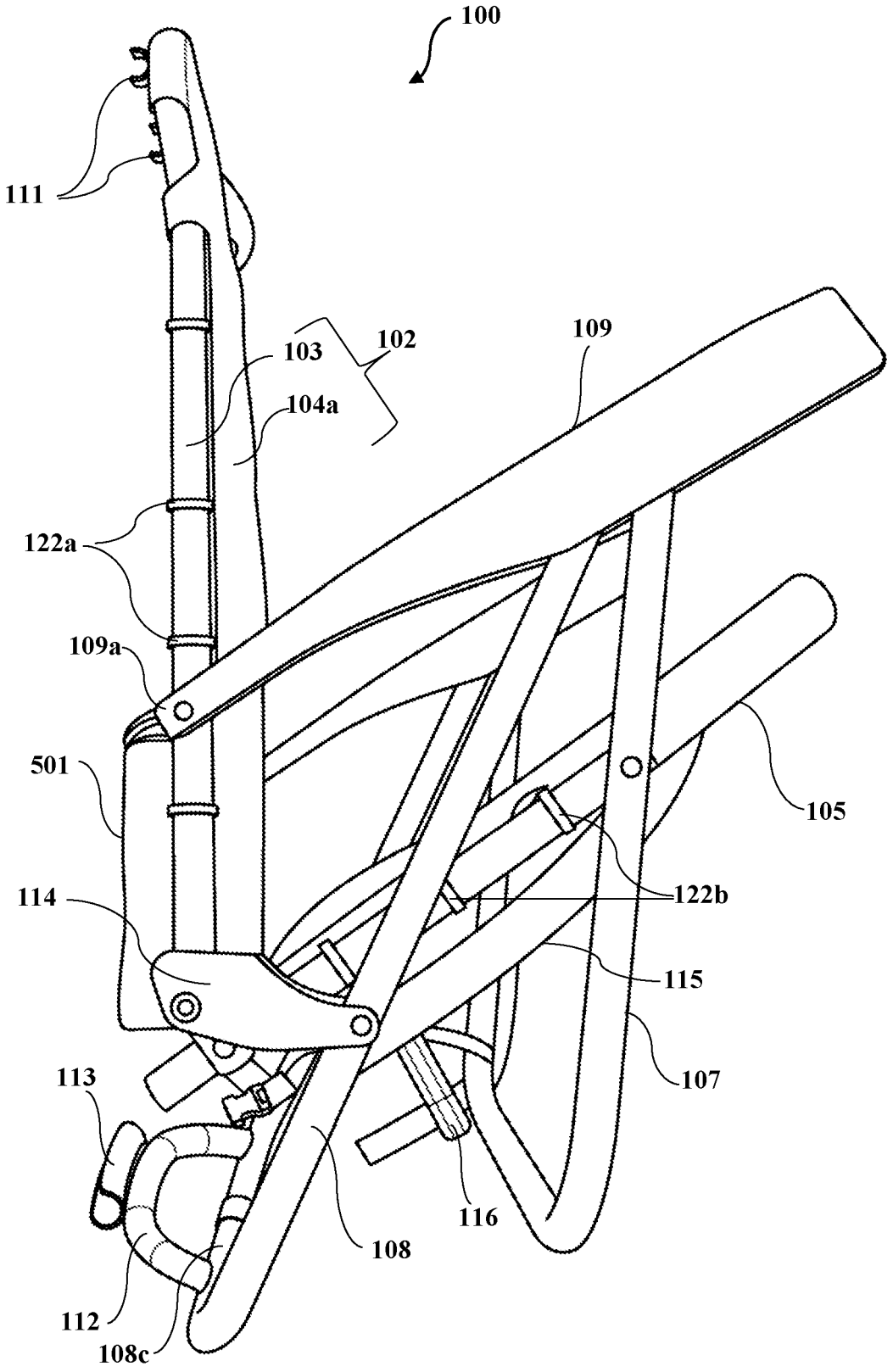
Figure 5C:
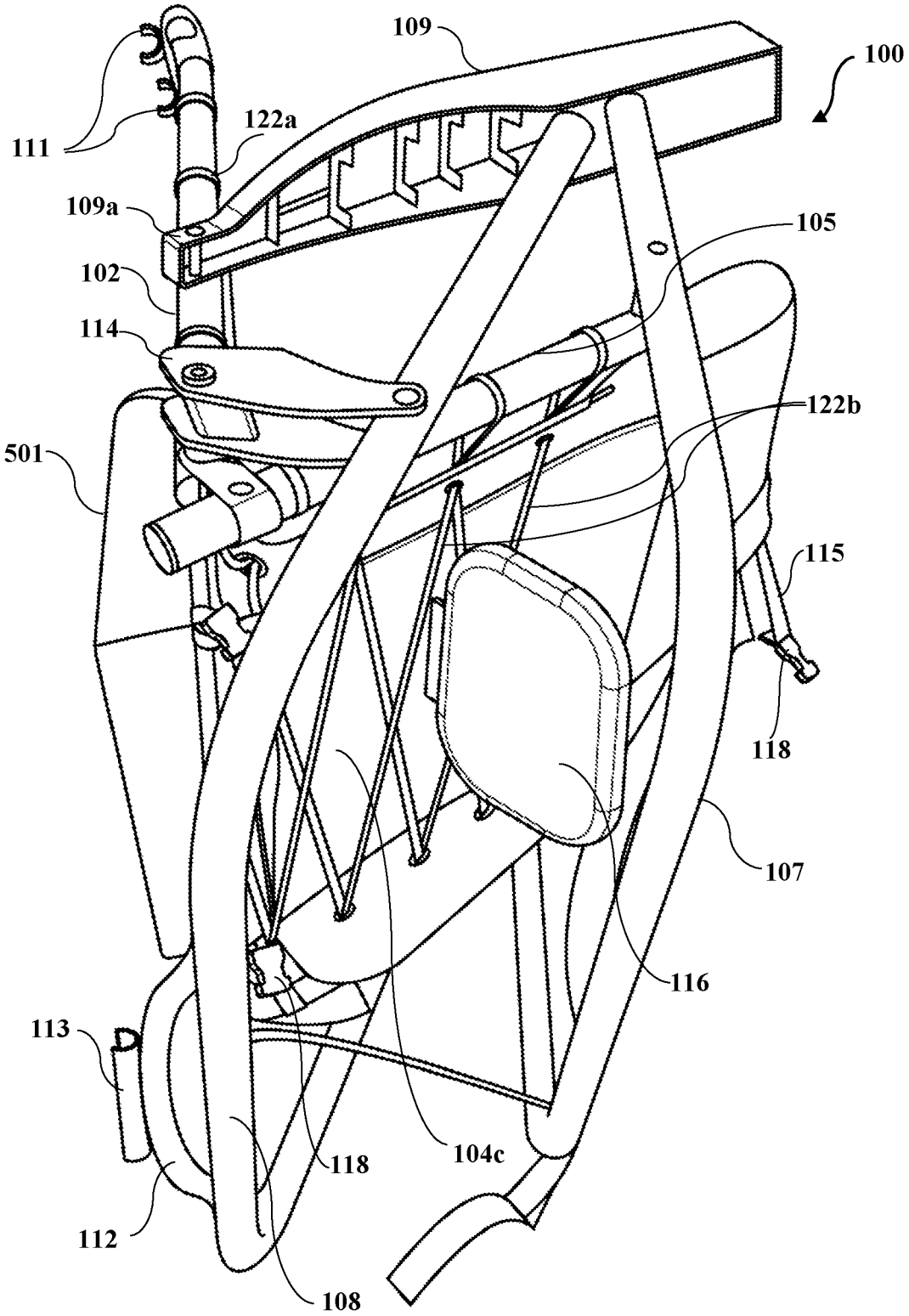

FIGS. 5A-5C illustrate left-side perspective views of another embodiment of the stackable, connectable folding chair 100, showing an operation of the stackable, connectable folding chair 100 from a deployed configuration to a folded configuration. In an embodiment, the backrest 104*a* and the seat 104*b* are attached to the back support frame 103 and the seat support frame 106 of the seat member 105 using ties 122*a* and 122*b* as illustrated in FIGS. 5A-5C. FIG. 5A illustrates a left-side perspective view of an embodiment of the stackable, connectable folding chair 100 in a deployed configuration. To change the configuration of the stackable, connectable folding chair 100 from the deployed configuration to the folded configuration, a user may raise the seat member 105 in an upward direction as illustrated in FIG. 5B. The pivotal connection of the generally U-shaped front leg frame 107 and the generally U-shaped rear leg frame 108 to the pair of arm rests 109, and the pivotal connection between the generally U-shaped rear leg frame 108 and the generally U-shaped back support frame 103 via the leg locking member 114, allow the configuration of the stackable, connectable folding chair 100 to be changed from the deployed configuration to the folded configuration. FIG. 5C illustrates a left, bottom perspective view of the stackable, connectable folding chair 100, showing the ties 122*b* used for attaching the seat 104*b* to the seat support frame 106 of the seat member 105. Also illustrated in FIG. 5C is the support pad 116 suspended from the rear section 104*c* of the bottom surface of the seat member 105. In an embodiment, a receptacle 501, for example, a pouch, a pocket, a bag, or the like, is attached to a rear surface of the backrest 104*a* for containing additional items, for example, personal items for leisure, travel, beach excursions, or the like. The receptacle 501 can include a closeable top for safe storage of additional items within the receptacle 501.

Figure 6:
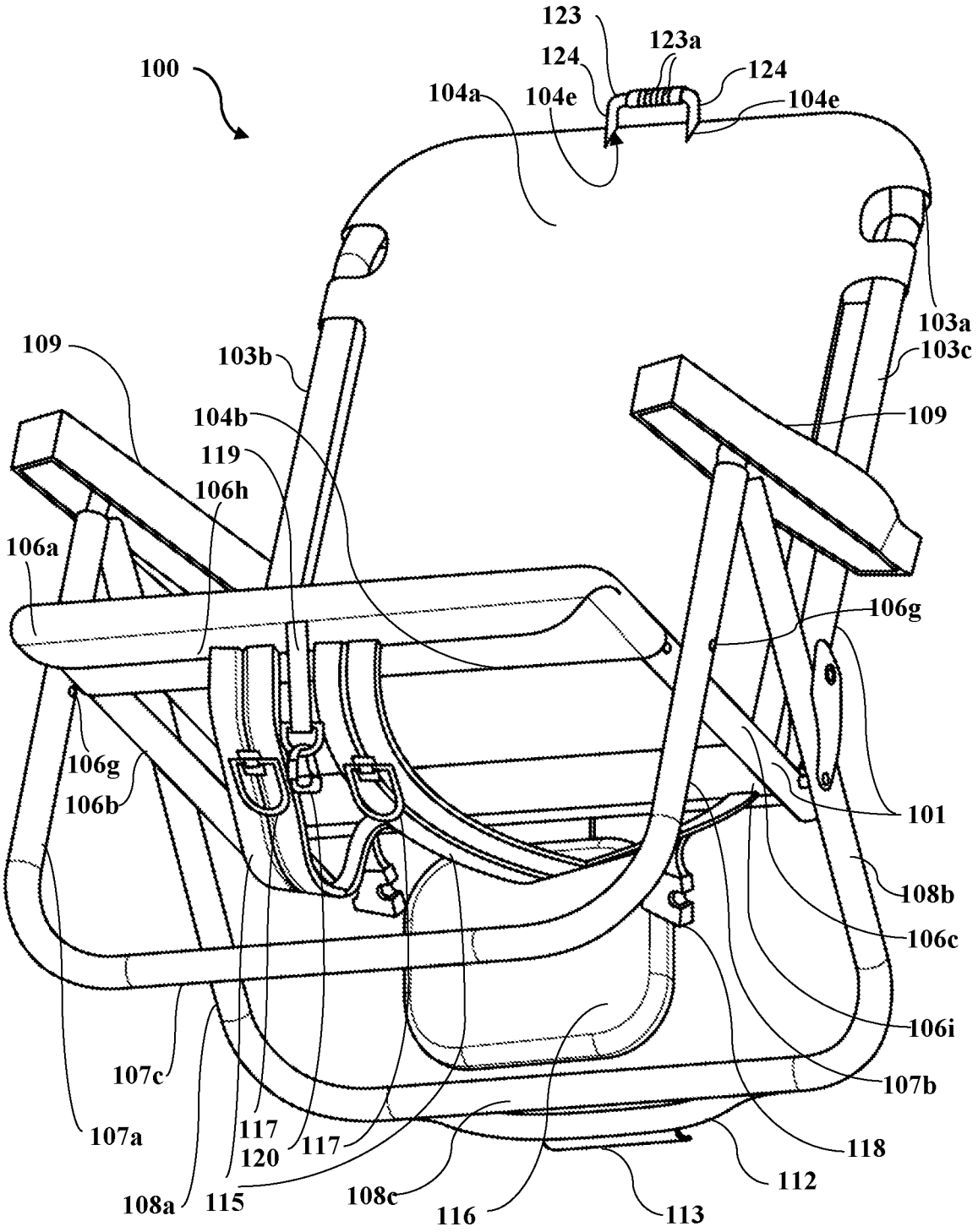
FIG. 6 illustrates a front, bottom perspective view of another embodiment of the stackable, connectable folding chair in a deployed configuration, showing a lifting handle attached to a top bar of a back support member of a support frame for allowing a user to grip and carry the stackable, connectable folding chair.

FIG. 6 illustrates a front, bottom perspective view of another embodiment of the stackable, connectable folding chair 100 in a deployed configuration, showing a lifting handle 123 attached to the top bar 103*a* of the back support frame 103 for allowing a user to grip and carry the stackable, connectable folding chair 100. The lifting handle 123 is configured to be gripped by a user for carrying the stackable, connectable folding chair 100. In an embodiment, the lifting handle 123 comprises ridges 123*a* (e.g., a textured surface) for providing an improved grip to the user's hand. In an embodiment, the lifting handle 123 comprises a pair of extensions 124 that wrap around or otherwise connect to the top bar 103*a* of the back support frame 103 to attach to the folding chair 100. The extensions 124 extend outwardly through openings 104*e* in the material of the backrest 104*a* to connect to opposing ends of the lifting handle 123. In some embodiments, the extensions 124 can be can be formed from a metal material that is belt and/or folded around the top bar 103*a* to allow for pivoting of the handle 123 relative to the top bar 103*a*. In some embodiments, the extensions 124 or the entire handle 123 can be formed from a strap or fabric material that wraps around the top bar 103*a* to allow for pivoting of the handle 123 relative to the top bar 103*a*.

Figure 7:
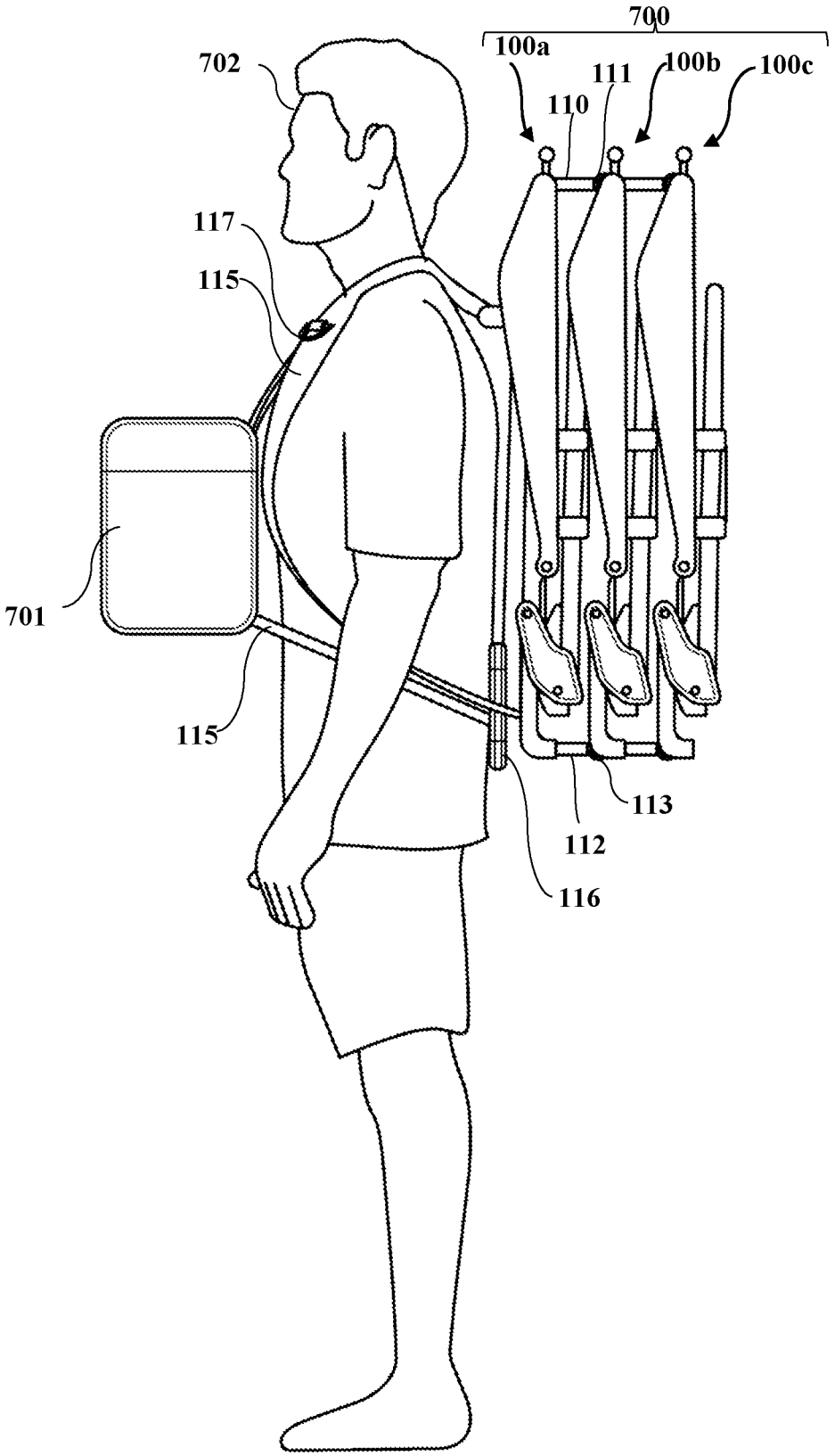
FIG. 7 illustrates a right-side elevation view showing an embodiment of the stackable, connectable folding chair in a folded configuration, connected and stacked to other folding chairs in the folded configuration via corresponding holders and carried by a user using the straps.

FIG. 7 illustrates a right-side elevation view showing an embodiment of the stackable, connectable folding chair 100*a* in a folded configuration, connected and stacked to other folding chairs 100*b* and 100*c* in the folded configuration via corresponding holders 111 and 113 and carried by a user 702 using the straps 115. The straps 115 allow the user to carry the stack 700 of folding chairs 100*a*, 100*b*, and 100*c* as a backpack. The user 702 folds each of the stackable, connectable folding chairs 100*a*, 100*b*, and 100*c* as disclosed in the description of FIGS. 5A-5C. The user 702 then uses the holders 111 and 113 to connect and stack the stackable, connectable folding chairs 100*a*, 100*b*, and 100*c* as disclosed in the description of FIG. 4. The user 702 then inserts their hands through the straps 115 and supports the stack 700 of connected folding chairs 100*a*, 100*b*, and 100*c* against the user's back. The first folding chair 100*a* is secured to the user 702 via the straps 115, such that the seat member 105 of the folded chair 100*a* contacts the user's rear side, while the pair of armrests 109 faces away from the rear side of the user 702. The support pad 116 of the stackable, connectable folding chair 100*a* lies flush against the user's back as illustrated in FIG. 7. The support pad 116 cushions and supports the user's lower back when the user carries and transports the stack 700 of connected folding chairs 100*a*, 100*b*, and 100*c*. The second folding chair 100*b* is oriented such that its armrests 109 also face away from the rear side of the user 702, allowing a third folding chair 100*c* to be secured to the holders 111 and 113 of the second folding chair 100*b*. As illustrated in FIG. 7, the top and bottom frame members (or uppermost and lowermost sections) of the chairs 100*a*, 100*b*, 100*c* can be substantially aligned along planes parallel to horizontal in the connected folded configuration.

In some embodiments, the user may attach a container 701, for example, a cooler, a bag, or the like, to the straps 115, via the attachment elements 117, for example, the b-rings, thereby allowing the user 702 to carry food items, drink items, and personal or other items in the container 701, while carrying the stack 700 of connected folding chairs 100*a*, 100*b*, and 100*c*. The attachment elements 117 allow the user 702 to attach other items, for example, an umbrella, a bag, or the like, directly to the straps 115. Supporting items, for example, container 701, and/or other items against the front of the user 702 using the straps 115, while the stack 700 of folding chairs 100*a*, 100*b*, and 100*c* are supported against the rear of the user 702, can allow for improved weight distribution, allowing the user 702 to carry more items more comfortably and without occupying the user's hands.

The foregoing examples and illustrative implementations of various embodiments have been provided merely for explanation and are in no way to be construed as limiting the embodiments disclosed herein. While the embodiments have been described with reference to various illustrative implementations, drawings, and techniques, it is understood that the words, which have been used herein, are words of description and illustration, rather than words of limitation. Furthermore, although the embodiments have been described herein with reference to particular means, materials, techniques, and implementations, the embodiments herein are not intended to be limited to the particulars disclosed herein; rather, the embodiments extend to all functionally equivalent structures, methods and uses, such as are within the scope of the appended claims. It will be understood by those skilled in the art, having the benefit of the teachings of this specification, that the embodiments disclosed herein are capable of modifications and other embodiments may be effected and changes may be made thereto, without departing from the scope and spirit of the embodiments disclosed herein.

The invention claimed is:

1. A folding chair, comprising:

a support frame comprising a back support member and a seat member;

a front leg frame connected to the seat member;

a rear leg frame connected to the back support member;

a pair of arm rests;

a first chair connecting member extending from a top bar of the back support member;

one or more first holders attached to the first chair connecting member and extending away from the first chair connecting member, wherein the one or more first holders are configured to connect to a corresponding top bar of a back support member of another folding chair;

a second chair connecting member extending from the rear leg frame;

one or more second holders attached to the second chair connecting member and extending away from the second chair connecting member, wherein the one or more second holders are configured to connect to a corresponding rear leg frame of the another folding chair.

2. The folding chair of claim 1, further comprising a support pad attached to and suspended from a rear section of a bottom surface of the seat member, wherein the support pad is configured to provide separation between a lower back of a user and the support frame when the user carries the folding chair using one or more straps attached to the bottom surface of the seat member.

3. The folding chair of claim 1, wherein the back support member of the support frame comprises a generally U-shaped back support frame configured to accommodate and support a backrest, and wherein the seat member of the support frame comprises a seat support frame configured to accommodate and support a seat.

4. The folding chair of claim 1, wherein the front leg frame is a generally U-shaped front leg frame comprising a pair of front legs and a base connecting member, wherein the base connecting member is configured to connect lower ends of the pair of front legs to form a U-shape.

5. The folding chair of claim 1, wherein the rear leg frame is a generally U-shaped rear leg frame comprising a pair of rear legs and the base connecting member, wherein the base connecting member is configured to connect lower ends of the pair of rear legs to form a U-shape.

6. The chair of claim 1, wherein the one or more second holders define a width greater than a width of the one or more first holders, and the one or more second holders are configured to connect to a corresponding base connecting member of the rear leg frame of the another folding chair.

7. The folding chair of claim 1, comprising one or more straps attached to a bottom surface of the seat member, wherein the one or more straps allow for wearing and carrying of the folding chair against a lower back of a user.

8. The folding chair of claim 7, wherein the one or more straps comprise one or more attachment elements configured to attach and secure one or more of a plurality of items to the one or more straps.

9. The folding chair of claim 1, further comprising a leg locking member operably coupled to side bars of the back support member and to a mid-section of the rear leg frame, wherein the leg locking member is configured to pivot and lock the rear leg frame to the back support member in a folded configuration and a deployed configuration of the folding chair.

10. The folding chair of claim 1, further comprising a lifting handle attached to the top bar of the back support member of the support frame, wherein the lifting handle is configured to be gripped by a user for carrying the folding chair.

11. The folding chair of claim 1, wherein the one or more first holders comprises at least two first holders, and the one or more second holders are centrally aligned between the at least two first holders.

12. The folding chair of claim 1, wherein the one or more first holders comprise two first holders spaced from each other on opposing sides of the first chair connecting member, a width of each of the first holders dimensioned smaller than a width of each of the one or more second holders.

13. The folding chair of claim 1, wherein the first chair connecting member extends perpendicularly from the top bar of the back support member along a plane substantially parallel to horizontal.

14. The folding chair of claim 1, wherein the second chair connecting member extends at an upward angle the rear leg frame relative to horizontal such that the one or more second holders extend towards the one or more first holders.

15. The folding chair of claim 1, wherein each of the one or more first holders and each of the one or more second holders define a substantially C-shaped clamp.

16. The folding chair of claim 1, comprising a support pad suspended from a bottom surface of the seat member and configured to be disposed between a lower back of a user and at least a portion of the support frame when the user carries the folding chair on their back in a folded configuration.

17. A system for connecting and stacking folding chairs, the system comprising:

a plurality of folding chairs, each of the plurality of folding chairs capable of being positioned in a folded configuration and a deployed configuration, wherein the plurality of folding chairs are stackable and connectable to each other in the folded configuration;

one or more first holders configured for attachment to a top bar of a back support member of one of the plurality of folding chairs such that the one or more holders extend away from the top bar, wherein the one or more first holders of the each of the folding chairs are configured to releasably connect to a corresponding top bar of a back support member of another one of the plurality of folding chairs; and one or more second holders configured for attachment to a rear leg frame of one of the plurality of folding chairs such that the one or more second holders extend away from the rear leg frame, wherein the one or more second holders of the each of the folding chairs are configured to releasably connect to a corresponding rear leg frame of the another one of the plurality of folding chairs.

18. The system of claim 17, wherein each of the plurality of folding chairs are configured for stacking connection to one another with the one or more first holders and the one or more second holders to form a connected stack of folding chairs configured to be carried and transported by a user.

19. A connection assembly for stacking and connecting a plurality of folding chairs, the connection assembly comprising:

a first chair connecting member extending from a top bar of a back support member of each of the plurality of folding chairs;

one or more first holders attached to the first chair connecting member and extending away from the first chair connecting member, wherein the one or more first holders of the each of the plurality of folding chairs are configured to connect to a corresponding top bar of a back support member of another one of the plurality of folding chairs;

a second chair connecting member extending from a rear leg frame of the each of the plurality of folding chairs; and one or more second holders attached to the second chair connecting member and extending away from the second chair connecting member, wherein the one or more second holders of the each of the folding chairs are configured to connect to a corresponding rear leg frame of the another one of the plurality of folding chairs.

20. The connection assembly of claim 19, wherein the one or more second holders define a width greater than a width of the one or more first holders, and the one or more second holders are configured to connect to a corresponding base connecting member of the rear leg frame of the another one of the plurality of folding chairs.

* * * * *